US006520088B2

(12) United States Patent
Vosseler

(10) Patent No.: US 6,520,088 B2
(45) Date of Patent: Feb. 18, 2003

(54) RE-USABLE PRINTING FORM WITH A PRINTING SURFACE AND METHOD FOR FORMING IMAGES ON THE PRINTING SURFACE

(75) Inventor: Bernd Vosseler, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/848,691

(22) Filed: May 3, 2001

(65) Prior Publication Data

US 2001/0042469 A1 Nov. 22, 2001

(30) Foreign Application Priority Data

May 3, 2000 (DE) ..... 100 21 451

(51) Int. Cl.[7] ..... B41N 1/08
(52) U.S. Cl. ..... 101/478; 101/458; 101/467
(58) Field of Search ..... 101/453, 454, 101/458, 459, 463.1, 465, 466, 467, 478; 430/302

(56) References Cited

U.S. PATENT DOCUMENTS 4,718,340 A * 1/1988 Love, III ..... 101/467
5,233,921 A * 8/1993 John ..... 101/478
5,743,188 A 4/1998 Ghosh et al. ..... 101/467
5,870,955 A * 2/1999 Williams et al. ..... 101/453
5,925,496 A * 7/1999 Ghosh et al. ..... 101/453
5,927,206 A * 7/1999 Bacon et al. ..... 101/453
5,931,097 A 8/1999 Neifert et al. ..... 101/454

FOREIGN PATENT DOCUMENTS

EP 0 911 155 A1 4/1999

OTHER PUBLICATIONS

Derwent Abstract No. 83–805957/44 for Soviet Patent Application SU 984 878 A (Ermakov), dated Jan. 5, 1983.

* cited by examiner

*Primary Examiner*—Stephen R. Funk
(74) *Attorney, Agent, or Firm*—Laurence A. Greenberg; Werner H. Stemer; Ralph E. Locher

(57) ABSTRACT

A printing form that can be used many times has a printing surface which is provided with a metallic titanium layer. For imaging, the printing form is selectively coated hydrophilically in point-by-point manner by supplying controlled energy. After the printing, the image on the printing form can be erased by supplying heat; a method for forming images on a printing form and for erasing them; and a printing unit and a printing press including the printing form.

13 Claims, 2 Drawing Sheets

RE-USABLE PRINTING FORM WITH A PRINTING SURFACE AND METHOD FOR FORMING IMAGES ON THE PRINTING SURFACE

BACKGROUND OF THE INVENTION

Field of the Invention

The invention relates to a re-usable printing form with a printing surface, particularly for use in offset printing, and to a method for forming images on a re-usable printing form with a printing surface. An image is thus controllingly formable on the surface and erasable from the surface.

Lithographic printing is based upon exploiting the immiscibility of oil and water on a printing form; a lipophilic solution or a black or colored ink is retained by the image-forming regions, and the water or the hydrophilic solution is retained by the regions of the printing surface which do not form an image. When the suitably prepared printing surface is wetted with hydrophilic and lipophilic substance or solution, in particular water and black or colored ink, the regions not intended for image formation or imaging preferably retain the hydrophilic substances and repel the lipophilic substances, while the image-forming regions accept the lipophilic solution or black or colored ink and repel the hydrophilic substances. As a consequence, the lipophilic substance is then suitably transferred to the surface of a material whereon the image is to be fixed, such as paper, fabric, polymer, and the like.

For many years, aluminum has been employed as a base material for printing plates. Typically, the aluminum is first subjected to a granulation process and subsequently to an anodizing process. The anodizing serves to prepare an anodic oxide layer, the adhesion of which is improved by the granulation. The granulation enhances the hydrophilic properties of the background of the printing plate. In the anodizing process, a strong acid, such as sulfuric or phosphoric acid, is typically used, so that then by a further method, such as a thermal siliconizing process or so-called electrosiliconizing, the surface can be made hydrophilic.

The aluminum base or carrier is characterized by the fact that it has a porous, tear-resistant hydrophilic surface, which is quite particularly adapted to lithographic printing, especially in the case of long press runs. An additional use of hydrophilic barrier layers, especially comprising polyvinyl phosphoric acid, polyacrylic acid, silicates, zirconates, or titanates, is optional. A great many radiation-sensitive materials are known which are suitable for generating copies in the application of lithographic printing, as long as after being exposed to light and after a necessary or desirable development and fixing, they make an image region available that can be used for printing. For example, photopolymerizable substances can be used therefor.

The aforedescribed device is subjected to an image-forming or imaging exposure to light, by supplying energy selectively. This can be effected, for example, by an exposure to UV light through a mask, or by direct writing with a laser.

The lithographic printing plates of the aforedescribed type are conventionally treated with a developer solution, which is typically an aqueous alkaline solution with organic additives. The necessity for introducing considerable quantities of these substances and disposing of them has long been a special problem in the application of printing methods.

For this reason, for some time, efforts have been made to produce printing plates for which a wet-chemical developing process is unnecessary in order to create the image. To that end, ceramic oxides can be used, for example, in the form of coatings on a printing plate.

In the published European Patent Document EP 0 911 154 A1, $TiO_2$ and $ZnO_2$ are proposed as materials for the plate surface; they can be in ceramic form, either pure or also together with other metallic additives, in various mixture ratios. This surface is hydrophobic in the non-excited state and can be changed to a hydrophilic state by irradiation with ultraviolet light. By heating, this process of switching from one to the other can be reversed again. The imaging is then performed by illuminating the entire surface of the plate with ultraviolet light, and regions which are supposed to carry colored ink in printing are covered by a mask and film, respectively. For erasing the image, the image regions are thermally switched back or reversed, for example, with a laser beam.

U.S. Pat. No. 5,743,188 proposes the use of zirconate ($ZrO_2$) in ceramically pure form or in a form provided with other additives as an active material in the surface. The surface is exposed pointwise or point-by-point to laser radiation or, in other words, melted, and as a result converted from a hydrophilic, stoichiometric state to a lipophilic, substoichiometric state. This conversion to the substoichiometric state is performed by ablation (removal) of small quantities of the surface of the ceramic. The printing form can be erased by thermally oxidizing the surface.

The use of ceramic oxides as a printing surface has considerable disadvantages, however. Because ceramic oxides are very much harder and more brittle than metals, stresses occur in and between the layers, which result in separation from the substrate, whether it is a metal foundation or a film, especially of a polymer. Bending of the substrate, in particular, can cause cracks and spalling.

Large-area ceramic oxide layers are produced by a relatively complex process. Standard methods, such as cathode ray sputtering and thermal vapor deposition, are performed in a high vacuum, which entails high costs and makes it difficult to achieve a high throughput of material. Deposition with the aid of pulsed laser radiation by the so-called PLD process (pulsed laser deposition) is limited to small substrate areas and is also again performed under vacuum conditions. In wet-chemical processes, such as the sol-gel process, for example, the components of the ceramic to be deposited are in dissolved form in a liquid, which is applied as a thin film. To expel the solvent afterwards, the layers are tempered. The requisite temperatures are above the melting point of aluminum, which is used as a standard base or foundation for printed originals, so that aluminum sheets cannot be coated in this manner. Layers that are applied by plasma spraying are at least several hundred micrometers thick and are too rough and nonhomogeneous to be used as a printing surface.

To be able to exploit special material effects of ceramic oxides, care must furthermore usually be taken that the ceramic is in the correct phase. Especially under thermal stress and when switching thermally back and forth between states, undesired phase transitions can occur.

Furthermore, in forming images on a zirconate surface by point-type ablation, indentations can remain behind in the image matrix even after the image has been erased. When the next image is printed, these indentations can be deleterious to the printed outcome, producing what is known as ghosting. The removal of material also means only a limited number of imaging processes will be possible.

Even more-economical printing with direct imaging printing presses, wherein the subject to be printed is imaged directly on a printing surface with the aid of a laser and CtP systems (computer-to-plate systems), respectively, require the use of a printing form which can be erased after the printing and whereon a new subject can be imaged again.

SUMMARY OF THE INVENTION

It is accordingly an object of the invention to provide a re-usable printing form with a printing surface formed of a material having improved surface and processing properties, so that it is suitable for printing most varied images many times on the same printing surface. Costs are thereby lowered at the same time.

With the foregoing and other objects in view, there is provided, in accordance with one aspect of the invention, a re-usable printing form having a printing surface, comprising metallic titanium in the printing surface.

In accordance with another feature of the invention, the printing surface is on a carrier having therein at least one of aluminum, another metal, and plastic material.

In accordance with a further feature of the invention, the printing form is formed entirely of metallic titanium.

In accordance with an added feature of the invention, the metallic titanium is in the form of an alloy containing titanium.

In accordance with an additional feature of the invention, the proportion of titanium in the alloy is within a range between 50 and 100%.

In accordance with yet another feature of the invention, the proportion of titanium in the alloy is within a range between 95 and 100%.

In accordance with yet a further feature of the invention, the printing form is formed as a surface of one of a solid cylinder, a hollow cylinder, a sleeve and a plate.

In accordance with another aspect of the invention, there is provided a method for forming images on a re-usable printing form, which comprises a first step of providing a rewritable printing form with a printing surface having metallic titanium therein; a second step of creating an image on the printing surface by selectively supplying energy point-by-point; and a third step of erasing the image by supplying energy over a large area after a printing material has been printed.

In accordance with another mode, the method of the invention includes performing the second step by point-by-point hydrophilic converting with the aid of electromagnetic radiation; and performing the third step by heat treatment for supplying energy over a large area for hydrophobic converting.

In accordance with a further mode, the method of the invention includes providing the electromagnetic radiation by one of a laser and a diode.

In accordance with an added mode, the method of the invention includes providing the one of the laser and the diode for emitting at least one wavelength shorter than 420 nm.

In accordance with an additional mode, the method of the invention includes, in the third step, when supplying the energy over the large area, introducing as an aid at least one of water, alcohol, and an aqueous solution.

In accordance with yet another mode, the aqueous solution that is introduced is a mixture of alcohol and water.

In accordance with yet a further mode, the alcohol introduced alone and in the mixture is isopropanol.

In accordance with yet an added mode, the method of the invention includes performing the second step by point-by-point hydrophobic converting with the aid of electromagnetic radiation; and performing the third step by supplying energy over a large area for hydrophilic converting by UV irradiation.

In accordance with yet an additional mode, the method includes providing the electromagnetic radiation by one of a laser and a diode.

In accordance with still another mode, the method of the invention includes providing the one of the laser and the diode for emitting at least one wavelength in the infrared range.

In accordance with a further aspect of the invention, there is provided a printing unit having at least one re-usable printing form with a printing surface, comprising metallic titanium in the printing surface.

In accordance with a concomitant aspect of the invention, there is provided a printing press having at least one re-usable printing form with a printing surface, comprising metallic titanium in the printing surface.

According to the invention, a printing form with a titanium-containing surface is proposed as the printing surface. The term "titanium-containing surface", or surface containing titanium, is understood to mean a metallic surface which entirely comprises metallic titanium or an alloy containing titanium. Typically, the proportion of titanium in the alloy is in the range between 50 and 100%, and preferably between 95 and 100%. For example, this surface can be the untreated surface of a metal sheet of either titanium or an alloy containing titanium. Alternatively, this surface can be embodied as a thin layer that has been deposited on a carrier, such as a metal sheet, a plastic layer, or a film, by a suitable method, in particular galvanizing. The titanium-containing surface can also be in the form of a coating, of a plate or of a printing cylinder, for example.

As a result of a controlled energy supply, such as irradiation with electromagnetic energy, the titanium-containing surface changes its surface energy and can thus be switched from a hydrophobic state to a hydrophilic state. The polar and dispersive components of the surface energy in the exposed and unexposed state differ markedly from one another, so that the differences in wetting can be utilized for offset printing. The surface according to the invention, which has metallic titanium therein, can accordingly be subjected to a controlled method for image formation and erasure. For that purpose, two methods symmetrical to one another are available for selection: selective point-type or point-by-point hydrophilic converting together with large-area hydrophobic converting, and selective point-type or point-by-point hydrophobic converting together with large-area hydrophilic converting. In the first instance, a suitable laser or a light emitting diode is preferably used that emits in the ultraviolet spectral range, typically with a wavelength less than 420 nm. To return the surface to the outset state, the printing form can be treated with heat and/or water or an aqueous solution with various additives, in particular alcohols, and preferably isopropanol. It can then be dried with hot air. By point-by-point hydrophilic converting, an image can thus be furnished on the surface that can be erased by large-area hydrophobic converting.

In the second instance, a large-area hydrophilic state is provided. To that end, a suitable light source is used, typically a UV lamp. For selective point-by-point hydrophobic coating, a light source in the infrared spectral range, preferably a laser, is provided. Thus, as an alternative to the first instance, an image can be furnished on the surface by point-by-point hydrophobic converting that can then be erased by large-area hydrophilic converting.

The method according to the invention for forming and erasing images can be performed either inside or outside the printing unit or the printing press. One essential requirement is the exposure to light for imaging, using radiation, for example, using ultraviolet light, which effectively converts the hydrophobic titanium layer or titanium-containing alloy layer to a hydrophilic state. Thus the printing surface according to the invention can be processed in terms of images by exposure to light through a transparent original. The printing surface can also be exposed to light directly with digital information, for example, by a laser beam. The laser equipped with a suitable control system can be used to write on the background. Lasers which emit in the ultraviolet spectral range are preferred.

After a complete print run, the printing surface of the printing apparatus is cleaned of black or colored ink in a suitable manner. The image can be erased, and thus the printing surface can be re-used. The imaging and erasing can be performed a multiple number of times, because the printing surface is extremely durable and is abrasion proof for a long time period.

For producing the printing form, in a preferred embodiment, a metallic titanium layer is deposited, for example, by electrochemical methods, on an aluminum sheet of the type used as base material for conventional printing plates. The coated metal sheet is then spread out on the plate cylinder of a direct imaging printing press. For pretreatment purposes, the plate is first wetted with clean water, for example using an additional moistening unit, and dried with hot air, so that it is put in the hydrophobic state. The imaging is then performed with a suitable laser head of the direct imaging printing press that emits ultraviolet radiation. The requisite intensities are markedly less than in thermal imaging, because the material is not heated but merely needs to be exposed to light, comparably to a film. In contrast with conventional plate imaging, here the regions that carry no colored ink and accordingly are not meant for printing are exposed to light. The printing plate can then be used for printing like a conventional printing plate. Once the job has been finished, the plate does not need to be replaced; it merely has to be returned to the hydrophobic outset state, using water and hot air.

The use of a metallic titanium-containing surface offers a number of advantages. The coating having metallic titanium therein of a metal sheet for the printing form is not as vulnerable to bending as a printing form with a ceramic surface. Producing metal layers is markedly simpler than producing ceramic layers, because access can be had to methods such as galvanizing that can be employed on a large scale. The surface roughness can be adjusted by way of the surface property of the metal carrier sheet and/or the plastic carrier, in order to create optimal conditions for the offset printing. Because, when switching from the hydrophobic to the hydrophilic state and back again, no material is removed from the printing plate, the plate can be erased and rewritten many times. Because the titanium surface itself is hydrophilic or hydrophobic, it is no longer absolutely necessary to use the relatively expensive, aforedescribed anodized aluminum as the base material; instead, even an inexpensive tin plate can, for example, be used.

Other features which are considered as characteristic for the invention are set forth in the appended claims.

Although the invention is illustrated and described herein as embodied in a re-usable printing form with a printing surface and a method for forming images on the printing surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
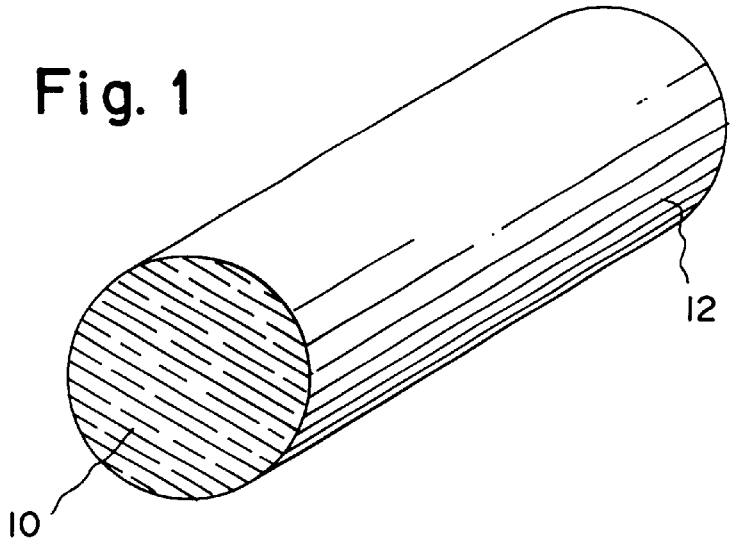
FIG. 1 is a fragmentary diagrammatic isometric or perspective view of an exemplary embodiment of a printing form cylinder formed entirely of metallic titanium.

In a first embodiment of the invention, a printing device according to the invention has a solid or monolithic printing form cylinder, which is formed partly or entirely of metallic titanium. In the case of a printing form which is formed partly of metallic titanium, at least the outer printing surface has such a composition. A representative example of such a printing form cylinder is shown in FIG. 1. A solid printing form cylinder 10 is formed entirely of metallic titanium and has an outer printing surface 12 of metallic titanium.

Figure 2:
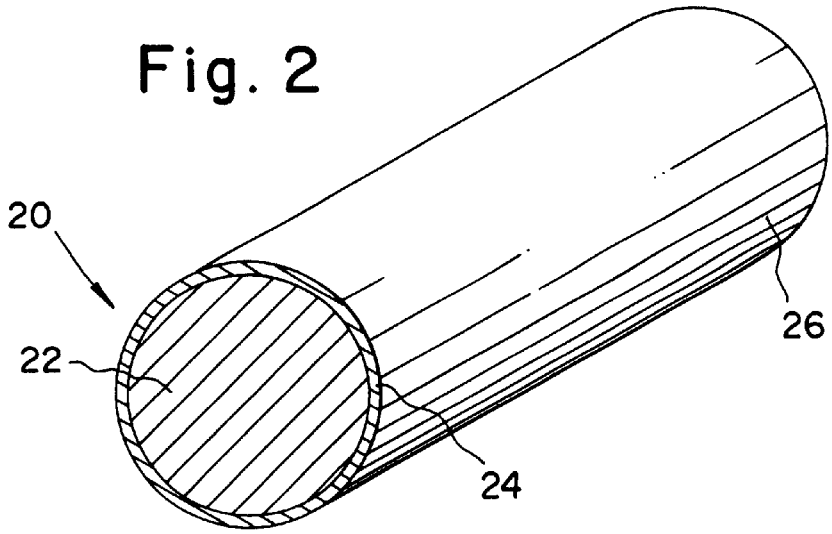
FIG. 2 is a view like that of FIG. 1 of another exemplary embodiment of a printing form cylinder, having a suitable base or carrier material as a core thereof and a titanium-containing surface.
Figure 3:
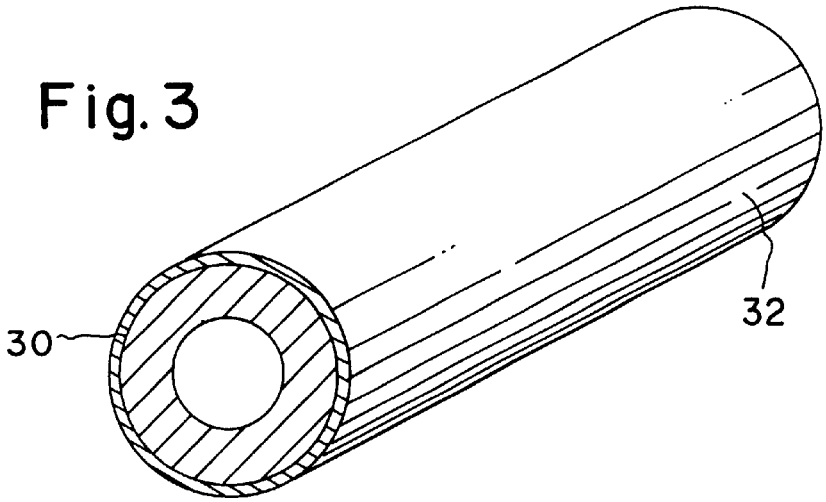
FIG. 3 is a view like those of FIGS. 1 and 2 of a hollow printing sleeve according to the invention, which has a titanium-containing surface.

In a further embodiment shown in FIG. 2, the cylinder 20 has a core 22, in particular of metal, an alloy, or a ceramic, whereon the surface having metallic titanium has been applied as a layer or sheathing 24 or has been deposited in a suitable manner, thus furnishing an outer printing surface 26. Alternatively thereto, the layer or sheathing 24 that has the metallic titanium therein can also be a hollow cylindrical tube or a printing jacket, of the type shown in FIG. 3. The tube 30 has a surface 32 formed of a metallic titanium layer. The thickness of such tubes varies over a wide range. In practical use, several centimeters has proven to be a suitable thickness. The cores of such printing forms are generally formed of one or more metals, such as ferrous metals, nickel, brass, copper, or magnesium, or alloys thereof, or of nonmetallic materials. Steel cores are preferred. The metal or alloy cores, as well as nonceramic cores, can be hollow or entirely solid, or else are formed of one or more types of metal or alloys or nonmetallic inorganic or organic materials. The titanium-containing layer applied to the aforedescribed cores or carriers generally has a uniform thickness of several micrometers.

Figure 4:
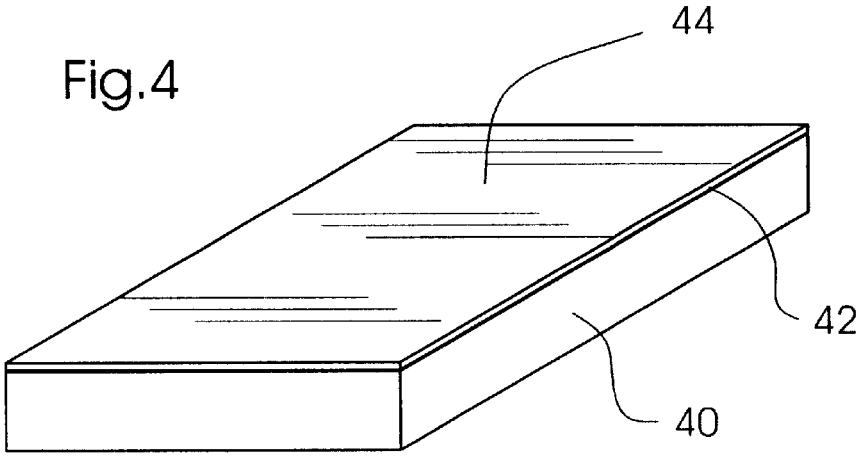
FIG. 4 is a greatly enlarged fragmentary diagrammatic isometric or perspective view of a printing form or plate, which is formed of a base or carrier material whereon a surface layer having metallic titanium is applied.

FIG. 4 shows a printing plate according to the invention in a fragmentary isometric or perspective view. The suitable base or carrier material 40, which is formed of metal or a metal-containing alloy or ceramic, carries a layer that has a metallic titanium layer 42. The face 44 is used for printing. Such a plate can also be applied in curved fashion, typically supported by rollers, to a suitable printing unit or a suitable printing press.

Figure 5:
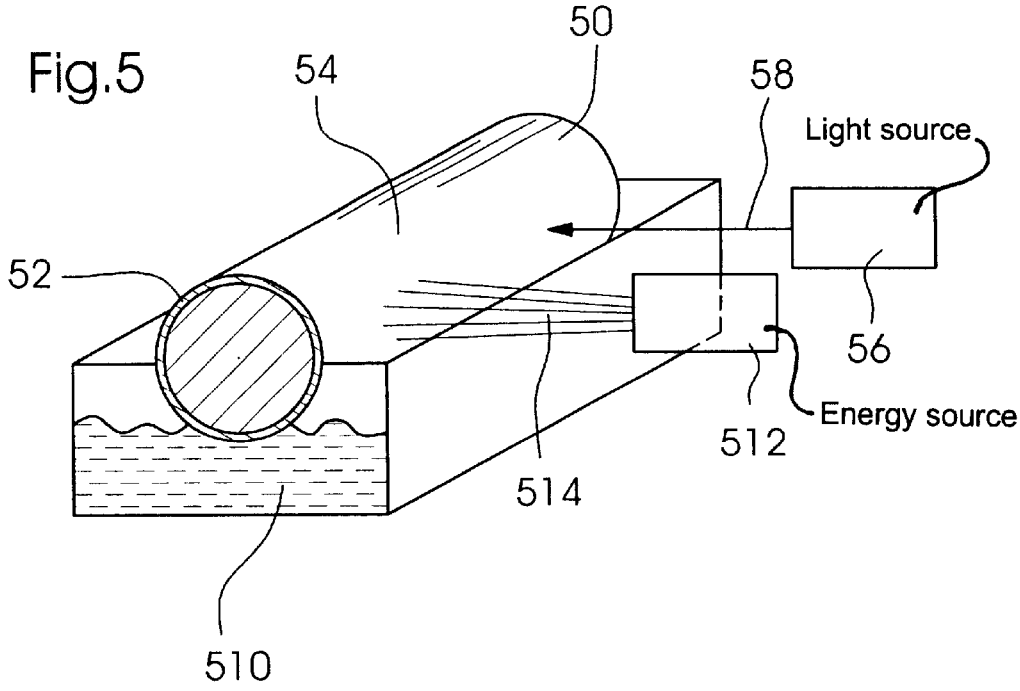
FIG. 5 is a fragmentary diagrammatic isometric or perspective view of a cylinder with a titanium-containing surface, which can be provided with an image by selectively supplying energy pointwise or point-by-point, and the image can be erased by supplying energy over a large area.

In FIG. 5, the method according to the invention for forming and erasing images on the printing form of the invention is illustrated in a simplified diagrammatic manner. The cylinder 50 carries a layer or a sleeve or a jacket 52, which has the titanium-containing surface 54 that can be used for printing. Depending upon the desired method step, in a first instance, energy is supplied selectively in point-type or point-by-point manner to the surface from the light source 56 by the outgoing beam 58, or, in a second instance, over a large area from the energy source 512 through the radiation sector 514.

In the first aforedescribed instance, this involves a light source 56 which emits in the UV range, and an energy source 512, in particular a heater for supplying heat. In the second instance, an IR laser is provided for the light source 56, and a UV lamp is provided for the energy source 512. Optionally, the water or the aqueous solution 510 can reinforce the process of hydrophobic converting.

The device shown in FIG. 5 can be realized either inside or outside a printing unit or a printing press with a topology suitable for this layout or with additional elements, such as applicator rollers, optics, and the like.

I claim:

1. A re-usable printing form, comprising: a printing surface, said printing surface and the printing form formed entirely of metallic titanium.

2. The printing form according to claim 1, wherein the printing form is formed as a surface of one of a solid cylinder, a hollow cylinder, a sleeve and a plate.

3. A printing unit, comprising: at least one re-usable printing form with a printing surface, said printing form and said printing surface formed entirely of metallic titanium.

4. A printing press, comprising: at least one re-usable printing form with a printing surface, said printing form and said printing surface being formed entirely of metallic titanium.

5. A method for forming images on a re-usable printing form, which comprises a first step of providing a rewritable printing form with a printing surface having metallic titanium therein; a second step of creating an image on the printing surface by selectively supplying electromagnetic radiation point-by-point for hydrophilic conversion; and a third step of erasing the image by heat treatment for supplying energy over a large area for hydrophobic conversion after a printing material has been printed.

6. The method according to claim 5, which includes providing the electromagnetic radiation by one of a laser and a diode.

7. The method according to claim 6, which includes providing the one of the laser and the diode for emitting at least one wavelength shorter than 420 nm.

8. A method for forming images on a re-usable printing form, which comprises a first step of providing a rewritable printing form with a printing surface having metallic titanium therein; a second step of creating an image on the printing surface by selectively supplying energy point-by-point; and a third step of erasing the image by supplying energy over a large area after a printing material has been printed, which includes, in the third step, when supplying the energy over the large area, introducing as an aid at least one of water, alcohol, and an aqueous solution.

9. The method according to claim 8, wherein the aqueous solution that is introduced is a mixture of alcohol and water.

10. The method according to claim 9, wherein the alcohol is isopropanol.

11. A method for forming images on a re-usable printing form, which comprises a first step of providing a rewritable printing form with a printing surface having metallic titanium therein; a second step of creating an image on the printing surface by selectively supplying electromagnetic radiation point-by-point for hydrophobic conversion; and a third step of erasing the image by UV irradiation for supplying energy over a large area for hydrophilic conversion after a printing material has been printed.

12. The method according to claim 11, which includes providing the electromagnetic radiation by one of a laser and a diode.

13. The method according to claim 12, which includes providing the one of the laser and the diode for emitting at least one wavelength in the infrared range.

* * * * *